United States Patent [19]

Blum

[11] 4,403,375

[45] Sep. 13, 1983

[54] TYING DEVICE

[76] Inventor: Ronald D. Blum, 838 Orchard Rd. SW., Roanoke, Va. 24014

[21] Appl. No.: 395,621

[22] Filed: Jul. 6, 1982

[51] Int. Cl.[3] ..... F16G 11/00; B65D 63/00

[52] U.S. Cl. ..... 24/16 PB; 24/119; 248/74 PB

[58] Field of Search ..... 24/16 PB, 17 AP, 17 A, 24/30.5 P, 206 A, 208 A, 214, 297, 117, 119, 140, 17 R; 248/74 PB, 71, 73; 292/321, 322; 36/50, 51, 53

[56] References Cited

U.S. PATENT DOCUMENTS

| | | | |
|---|---|---|---|
| 428,758 | 5/1890 | Mayfield | 24/119 |
| 537,934 | 4/1895 | Patton | 24/119 |
| 640,004 | 12/1899 | Larew | 24/119 |
| 725,536 | 4/1903 | Bernauer | 24/119 |
| 1,303,868 | 5/1919 | Eklund | 24/140 |
| 1,775,013 | 9/1930 | Yugawa | 24/16 PB |
| 2,175,962 | 10/1939 | Kenifick | 24/128 |
| 2,674,021 | 4/1954 | Cataldi | 24/119 |
| 2,961,785 | 11/1960 | Toepfer | 24/16 PB |
| 2,977,145 | 3/1961 | Rifkin | 24/16 PB |
| 3,147,522 | 9/1964 | Schumm | 24/16 |
| 3,147,523 | 9/1964 | Logan | 24/121 |
| 3,166,809 | 1/1965 | Manship | 24/121 |
| 3,176,362 | 4/1965 | Tames | 24/120 |
| 3,197,830 | 9/1965 | Hoadley | 24/16 |
| 3,227,991 | 1/1966 | Zdanis | 24/130 |
| 3,229,340 | 1/1966 | Herdman | 24/119 |
| 3,296,669 | 1/1967 | Elder, Jr. | 24/121 |
| 3,321,815 | 5/1967 | Herdman | 24/119 |
| 3,345,707 | 10/1967 | Rita | 24/120 |
| 3,345,707 | 10/1967 | Rita | 24/120 |
| 3,362,411 | 1/1968 | Moller | 24/16 |
| 3,362,412 | 1/1968 | Moller | 24/16 |
| 3,363,293 | 1/1968 | Nemrod et al. | 24/30.5 P |
| 3,365,753 | 1/1968 | Prenner et al. | 24/16 PB |
| 3,417,578 | 12/1968 | Anderson | 24/265 |
| 3,418,733 | 12/1968 | Tyrell, Sr. et al. | 24/143 |
| 3,467,427 | 9/1969 | Moberg | 292/322 |
| 3,473,198 | 10/1969 | Meier | 24/119 |
| 3,486,200 | 12/1969 | Orenick | 24/16 |
| 3,500,508 | 3/1970 | Bennett | 24/115 |
| 3,513,508 | 5/1970 | Modeme | 24/16 |
| 3,537,151 | 11/1970 | Sobel et al. | 24/117 |
| 3,556,575 | 1/1971 | Farkas | 24/16 PB |
| 3,577,606 | 5/1971 | Tyrrell, Sr. | 24/117 |
| 3,593,950 | 7/1971 | Tetzlaff | 248/74 PB |
| 3,618,173 | 11/1971 | Schwartz | 24/16 |
| 3,739,430 | 6/1973 | Kohke | 24/16 PB |
| 3,913,179 | 10/1975 | Rhee | 24/16 |

FOREIGN PATENT DOCUMENTS

| | | | |
|---|---|---|---|
| 692631 | 8/1964 | Canada | 24/16 PB |
| 1271064 | 7/1961 | France | 24/17 AP |
| 227423 | 11/1969 | U.S.S.R. | 24/16 PB |

*Primary Examiner*—John J. Wilson

*Attorney, Agent, or Firm*—Lalos, Leeds, Keegan, Lett & Marsh

[57] ABSTRACT

A low profile, flexible tying device for holding or retaining shoelaces in place. The device includes a base portion having a slot and a tongue portion for insertion into the slot. A portion of the tongue portion is serrated to engage surfaces defining the slot to lock the device about a shoe lace knot. Dimples are provided on the tongue portion for gripping the shoelace material.

6 Claims, 5 Drawing Figures

TYING DEVICE

BACKGROUND AND DISCUSSION OF THE INVENTION

Although there have been a number of tying devices employed to hold shoelaces together or otherwise prevent them from becoming untied, many of these devices have suffered from a number of inadequacies which has prevented their being readily acceptable in the marketplace. These inadequacies included the awkward manner in which the devices are used in connection with the shoe, the complexity of the device itself, the rigidity, bulkiness, and unappealing appearance of the device, and its cost of manufacture. For example, where certain substantially rigid devices have been employed, often a number of separate elements must interact, or the shoelaces must actually be tied through certain elements on the device, before the device itself actually can be fixed to the shoe. The awkardness and complexity characterizing such devices impair acceptance by the general public because of the time and effort involved to place it on the shoe and integrate it with the laces. In addition, such rigid devices are typically unsightly and can not be used in an inconspicious manner.

With regard to flexible type devices, although there have been such devices used for bundling certain elements, they have not been readily adaptable for use with shoelaces. As with the rigid devices, flexible ties are generally unsightly, are not configured properly to hold the shoelace in place or are otherwise too cumbersome to enjoy wide acceptance.

The invention described herein overcomes many of the deficiencis discussed above. The invention relates to a flexible, low-profile, adjustable device for holding or retaining tied shoelaces in place. A common problem particularly with children is that their shoelaces are constantly becoming untied from contact with depris, subjection to consistent vibration, and the natural inclination of some shoelace material to become untied.

A device for this purpose includes a base portion, having a slot therethrough and a tongue portion extending from the base portion for insertion into a receiving slot. The tongue portion is further comprised of two separate portions, a serrated portion and a tail portion. The serrated portion includes a number of wedge members formed adjacent one another and having tearlines across their junctures. This configuration provides for adjustability and permits a portion of the device to be torn away from the remaining portion of the device locked about the shoelace. In addition, there is provided a tail portion without any serrations or wedge portions for facilitating the insertion of the tongue into the orifice for this purpose. The invention includes dimples configured and spaced to hold the tie in place about a shoelace knot and to prevent the shoelace knot from becoming untied. The edges of the base portion defining the slot also engage the knot thereby preventing lateral movement of the device. This configuration allows efficient locking of shoelaces to maintain them in a tied disposition while also providing a low profile device which is relatively inexpensive to manufacture and simple to use. Additional advantages will be appreciated from the detailed description of the preferred embodiment which follows.

DETAILED DESCRIPTION OF THE PREFERRED EMBODIMENT

Figure 2:
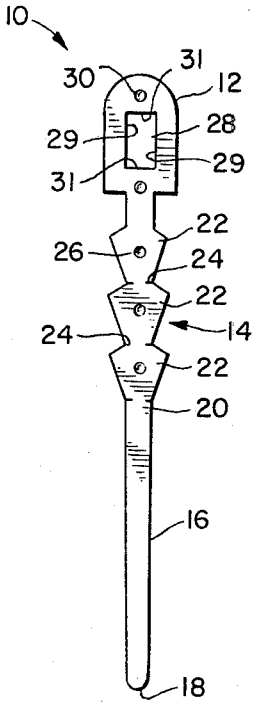
FIG. 2 is a top view of the tying device.
Figure 3:
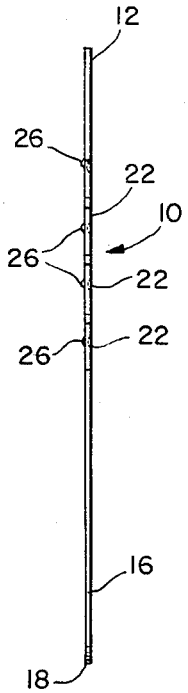
FIG. 3 is a side view of the tying device as shown in FIG. 2.

In referring to FIG. 2, it can be seen that flexible tying device 10 includes a base portion 12 and a tongue portion 14. The base portion 12 has a rectangular slot 28 cut entirely therethrough for receiving tongue portion 14 when the device is wrapped about a shoelace knot. Extending from and fixed to base portion 12 in a generally planar configuration as can be seen in FIG. 3 is a tongue portion 14 comprising a tail portion 16 and a serrated portion 15. As shown there are three (3) wedge portions 22 contiguous with one another which comprise tongue portion 14 between tail portion 16 and the base portion 12. Each one of these wedge portions is about 0.37 inches in length, includes flanged side edges at about 18° to the longitudinal axis which intersect rear flange edges about 30° to an axis perpendicular to the longitudinal axis of the device. The resulting configuration is a wedge-shaped or arrow-shaped portion.

The juncture 24 of these wedges with one another is crimped to allow a portion of tongue 14 to be torn away once the tongue has been inserted into slot 28. There is also a crimp portion 20 defining the juncture between the wedge portion distal from base portion and the tail portion 16. On the other hand the wedge portion 22 closest to base 12 is not provided with such a crimp so that there always remains at least one wedge portion 22 fixed to the base 12 when device 10 is locked into place. Tail portion 16 has a very slight taper inwardly from the juncture with outer most wedge portion 22 to tip 18 of about 1° to the longitudinal axis. This configuration allows the tongue to be easily grasped and pulled through slot 28 for locking the device 10 in place.

Each one of these wedge portions are provided with a dimple 26 generally in the center of each wedge portion 22. These dimples 26 act as a grasping device for grasping the knot and holding the knot in place as well as securing device 10 thereabout. An additional hole 30 is provided through the base 12 to provide a means for holding a number of devices 10 on a ring or similar holder.

Figure 4:
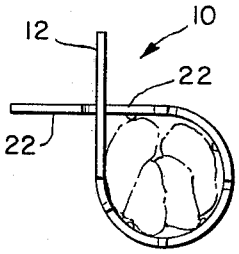
FIG. 4 is a side view of the device as shown in FIG. 1 locked about a shoelace knot.

The maximum width of each wedge portion 22 is greater than that of slot 28 but less than that of the slot length. This configuration allows the wedges 22 to be pulled through slot 28 when oriented properly, but prevents retraction or unlocking. Locking results from the natural inclination of the device to orient itself such that the rear edges of a wedge 22 engage the adjacent surfaces of base 12 defining slot 28 as shown in FIG. 4.

Figure 1:
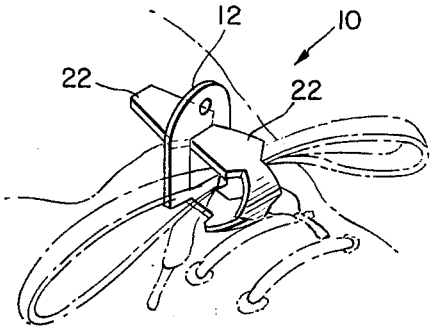
FIG. 1 is a perspective view of the tying device locked about the knot of a shoelace with the tail portion having been torn away.

As can be seen in FIG. 3 the device is generally planar in configuration. The thickness dimension, as can be seen FIG. 3, is substantially less than the length and width dimensions, as can best be seen in FIG. 2. In other words the device is thin having a thickness in this preferred embodiment of about 1/32 inch. The device is also flat or planar with the only deviation from a flat surface being the raised portion of the dimples 26 on the top surface and the dimple recesses on the bottom surface. It is sufficiently fiexible to wrap easily about a knot as shown in FIGS. 1, 4, have the tongue portion pulled through slot 28 and a portion torn off to lock the device 10 in place and remove extraneous portions of the device. However, the device is also sufficiently resilient that it tends to return to its natural planar state when bent into some other configuration.

Figure 5:
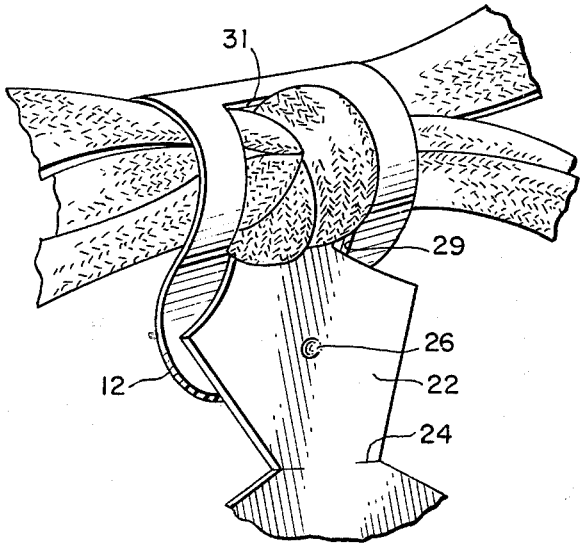
FIG. 5 is an enlarged perspective view of the tying device locked about a shoelace knot to expose a portion of the knot.

Slot 28 performs another function besides that discussed above. When device 10 is tightened sufficiently about a knot, the portion of the knot circumscribed by slot 28 will bulge through the slot. This bulged portion is enlarged by the laterally spaced slot edges 29 to hold the knot in place and prevent lateral movement of tying device 10, as can be seen in FIG. 5. At least one slot longitudinal edge similarly engages this bulged portion to prevent relative movement about the knot.

In addition to these securing features slot 28 also enhances visual appeal of the device when locked in place. Because so much of the knot remains exposed via slot 28, the visual impact of the device 10 itself is diminished while the familar knot is readily open to view. This creates a more appealing configuration to the viewer when compared to larger, more obstrusive devices which might otherwise detract from the shoe appearance.

In operation shoelaces are initially tied in place. The device is then slid underneath the knot and wrapped around the knot with the raised portions of dimples 26 facing the knot. A portion of base 12 is allowed to remain on one side of the knot while the tail 16 is pulled through the slot 28 to secure device 10 tightly about the shoelace knot. To pull the wedge portions through slot 28, the tail portion 16 must be twisted slightly so that wedges 22 are oriented in a manner which allows them to pass through the dimensions of slot 28. Once tongue portion 14 has been pulled through sufficiently to tighten snugly the device about the knot, the exposed portion of the wedge 22 having the crimped juncture 24 is held while the remaining portion of the device is torn away along this crimped edge 24. This allows the removed portion to be disposed while having only a small portion of device 10 remain about the knot to secure it in place. This provides a low profile, inconspicuous device for holding shoelaces in place. Because of the cost of manufacture and the configuration employed, devices 10 are readily disposable.

Although, the device has been discussed in conjuction with shoelaces, it can be employed for other lace-type ties such as those used in bathing suits, halter tops, etc. Furthermore, the wedge portions allow for adjustability of the device to accomodate various size laces. For example, as shown, the first wedge portion 22 is for saddle oxford shoelaces or thin bathing suit straps, the middle portion 22 is for standard tennis shoelaces, and the third portion 22 is for thick leather laces.

To dislodge device 10, the shoelaces are simply untied in their normal manner. This will of course untie the knot and allow the device 10 to be removed and discarded. Thus, the device is relatively easy to secure and remove.

It should be understood that the above is merely a detailed description of the preferred embodiment. The scope of applicant's invention as well as any equivalents are define in the claims which follow.

I claim:

1. A tying device comprising:

(a) a resilient, flexible material having a generally flat configuration with a base portion defining a slot therethrough and a tongue portion extending from the base portion configured for insertion into the slot;

(b) said tongue portion including two portions, an intermediate portion having a plurality of wedge portions arranged contiguous with one another, and a tail portion extending from a wedge portion distal from said base portion, said tail portion have a width less than the width of the slot defined in the base portion for facilitating insertion of the tail portion therethrough;

(c) at least one of said wedge portions defining a grasping member extending from the surface thereof for grasping material to which said device can be secured;

(d) adjacent wedge portions being crimped therebetween to provide a tear line where the remaining portion of the tongue portion can be torn away once the device is locked in place, said wedge portion distal from said base portion is a distal wedge portion and includes a crimped portion at its juncture with the tail portion to provide a tear line where the tail portion can be torn away from the remaining portion of the device; and (e) said wedge portions having one end with a width less than the width at the opposite end, the maximum width of said wedge portion being less than the length of the slot but greater than the slot width to permit passing of said wedge portions through the slot while preventing retraction when oriented such that the maximum width of a wedge portion engages the adjacent surfaces of the base portion defining the slot.

2. The device according to claim 1 wherein three wedge portions are provided between the tail portion and the base portion, each of these wedge portions having a dimple thereon.

3. The device according to claim 2 wherein each wedge portion is identical in configuration to the adjacent wedge portion.

4. The device according to claim 3 wherein said base portion is provided with an additional hole therethrough for securing the device to a holder.

5. The device according to claim 4 wherein said slot is sufficiently large to expose a portion of a shoelace knot when said device is locked thereon.

6. The device according to claim 5 wherein said base portion includes lateral edges defining said slot, said lateral edges being spaced to engage a portion of a knot to prevent lateral movement of said device.

* * * * *